US009414472B2

(12) United States Patent
Gawrys

(10) Patent No.: US 9,414,472 B2
(45) Date of Patent: Aug. 9, 2016

(54) FILAMENT MISWIRE PROTECTION IN AN ELECTRONIC DIMMING BALLAST

(71) Applicant: Lutron Electronics Co., Inc., Coopersburg, PA (US)

(72) Inventor: Brent M. Gawrys, Allentown, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 982 days.

(21) Appl. No.: 13/629,903

(22) Filed: Sep. 28, 2012

(65) Prior Publication Data

US 2014/0091726 A1 Apr. 3, 2014

(51) Int. Cl.
*H05B 41/26* (2006.01)
*H05B 41/298* (2006.01)
*H05B 41/295* (2006.01)

(52) U.S. Cl.
CPC ..... *H05B 41/2985* (2013.01); *H05B 41/295* (2013.01)

(58) Field of Classification Search
USPC ..... 315/210, 211, 212, 215, 219, 220, 222, 315/291, 294, 297, 307, 308
See application file for complete search history.

(56) References Cited

U.S. PATENT DOCUMENTS 4,847,535 A 7/1989 Wisbey et al.
5,023,519 A * 6/1991 Jensen ..... H05B 41/2856 315/219
5,247,228 A 9/1993 Roche
5,656,891 A 8/1997 Luger et al.
5,877,592 A 3/1999 Hesterman et al.
6,326,740 B1 * 12/2001 Chang ..... H02M 7/53803 315/194
7,176,639 B2 * 2/2007 Hu ..... H05B 41/295 315/209 R
7,295,410 B1 11/2007 Packard et al.
7,586,268 B2 9/2009 Gawrys et al.
2007/0262734 A1 * 11/2007 Venkat ..... H05B 41/295 315/360
2008/0258551 A1 10/2008 Chitta et al.
2009/0267518 A1 10/2009 Schemmel et al.
2011/0062878 A1 3/2011 Liess et al.

FOREIGN PATENT DOCUMENTS

WO WO 2010/110946 A1 9/2010

OTHER PUBLICATIONS

Cartwright, Ph.D., Kenneth V., "Non-Calculus Derivation of the Maximum Power Transfer Theorem", School of Sciences and Technology, College of the Bahamas, http://kvcartwright.googlepages.com/, Spring 2008, 19 pages.

* cited by examiner

*Primary Examiner* — Douglas W Owens
*Assistant Examiner* — James H Cho
(74) *Attorney, Agent, or Firm* — Condo Roccia Koptiw LLP

(57) ABSTRACT

An electronic dimming ballast that accommodates miswiring of fluorescent lamp filaments (e.g., miswiring the corresponding lamp sockets) is disclosed. The electronic dimming ballast may drive a plurality of gas discharge lamps. Each gas discharge lamp may have a respective filament. The electronic dimming ballast, via the filament miswire protection element, may establish the same voltage across a first of the filaments regardless of whether the filaments are wired in series or in parallel. The filament miswire protection element may have an impedance that is approximately equal to an impedance of at least one of the filaments. The filament miswire protection element may include one or more capacitors, inductors, and/or resistors. The filament miswire protection element may include only a capacitor.

19 Claims, 12 Drawing Sheets

FILAMENT MISWIRE PROTECTION IN AN ELECTRONIC DIMMING BALLAST

TECHNICAL FIELD

The present disclosure relates to electronic ballasts and, more particularly, to electronic dimming ballasts for gas discharge lamps, such as fluorescent lamps.

BACKGROUND

A typical fluorescent lamp includes a sealed glass tube containing a rare earth gas, and an electrode at each end for striking and maintaining an electric arc through the gas. The electrodes are typically constructed as filaments to which a filament voltage is applied to heat the electrodes, thereby improving their capability to emit electrons. This results in improved electric arc stability and longer lamp life.

Typical prior art ballasts apply the filament voltages to the filaments prior to striking the arc and maintain the filament voltages throughout the entire dimming range of the lamp. At low end, when light levels are lowest and, consequently, the electric arc is at its lowest level, the filament voltages help maintain a stable arc current. At high end, when light levels are highest, and the electric arc current is at its highest level, the electric arc current contributes to heating the filaments.

FIG. 1 is a perspective view of an example gas discharge lamp fixture 100. The fixture 100 includes a ballast 102, lamp sockets 104, and a housing 106. The ballast 102 and the sockets 104 may be fixed to the housing 106. The lamp sockets 104 may be sized and situated within the housing 106 to hold lamps 108. The ballast 102 may have wires 110 to connect the ballast 102 to the sockets 104 for driving the lamps 108 and for providing heating current, discussed above. In practice, the ballast 102 may be wired by a fixture supplier, as is common in new construction, or it may be wired by an on-site installer, as is common in retrofit projects.

Some ballasts are manufactured with the expectation that certain of the filaments are to be wired to the ballast in parallel with one another. Sometimes, such a ballast may be installed such that the filaments are inadvertently "miswired" in series with one another. Other ballasts are manufactured with the expectation that certain of the filaments are to be wired in series with one another. Sometimes, such a ballast may be installed such that the filaments are inadvertently "miswired" in parallel with one another. Certain problems may arise when the filaments are miswired. Not all of these problems are immediately apparent, and symptoms of these problems, such as shortened lamp life, may show up much later.

SUMMARY OF THE INVENTION

An electronic dimming ballast that accommodates miswiring of lamp filaments (e.g., miswiring the corresponding lamp sockets) is disclosed. The electronic dimming ballast may drive a plurality of gas discharge lamps. Each gas discharge lamp may have a respective filament. The electronic dimming ballast may include a filament winding and a filament miswire protection element. The filament winding may be magnetically coupled to an inductor. The filament winding may be operable to supply an AC filament voltage to each of the filaments. The filament miswire protection element may be coupled to the filament winding. The filament miswire protection element may be connectable to the filaments.

The electronic dimming ballast, via the filament miswire protection element, may establish the same voltage across a first of the filaments regardless of whether the filaments are wired in series or in parallel. For example, the electronic dimming ballast may establish a first voltage across each of the filaments when the filaments are wired in series and a second voltage across each of the filaments when the filaments are wired in parallel. The first and second voltages may be approximately equal.

The filament miswire protection element may have an impedance, at an operating frequency, that is approximately equal to an impedance of at least one of the filaments. For example, the filament miswire protection element may include one or more capacitors, inductors, and/or resistors. In an embodiment, the filament miswire protection element may include only a capacitor. In an embodiment, the filament miswire protection element may include only an inductor.

Other features and advantages of the disclosed ballast will become apparent from the following description that refers to the accompanying drawings.

DETAILED DESCRIPTION

Figure 1:
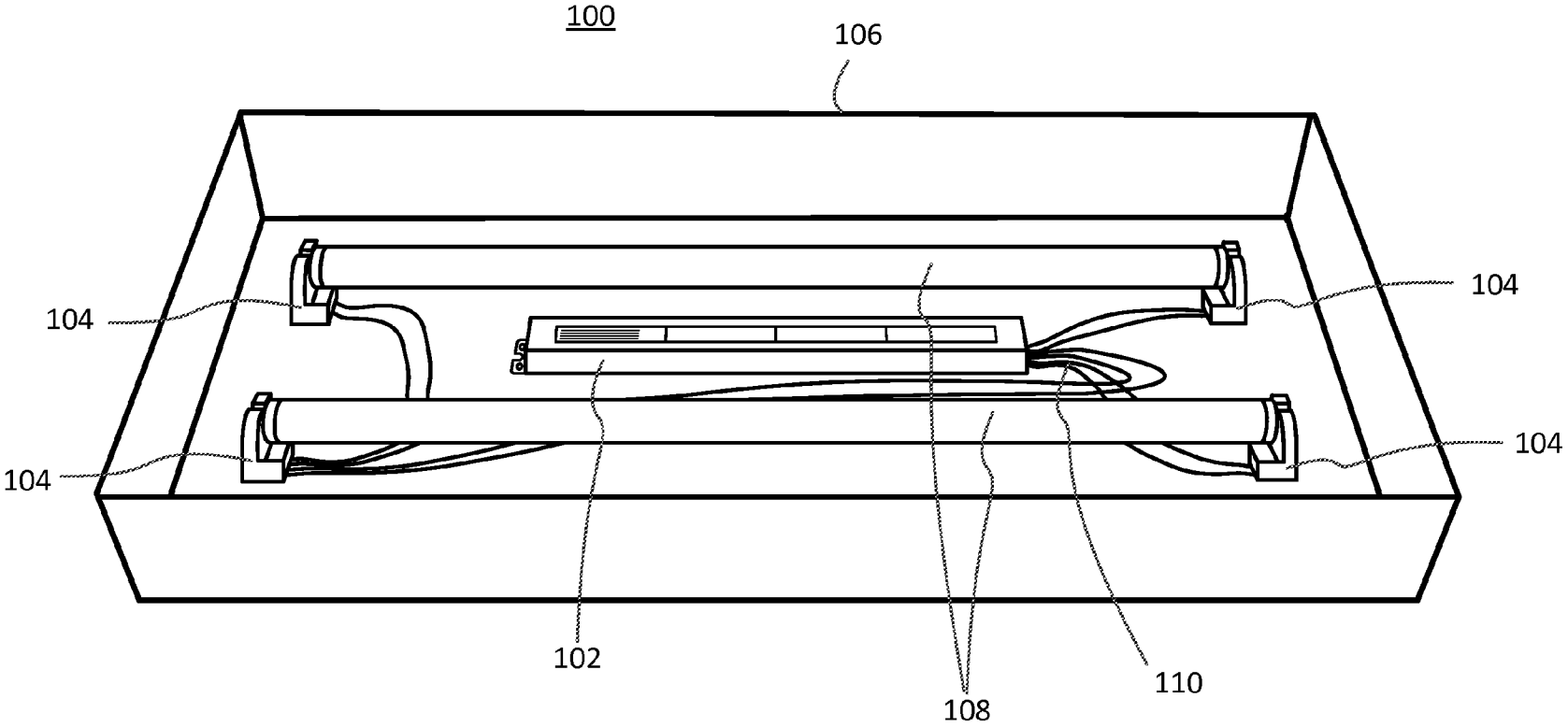
FIG. 1 is a perspective view of an example gas discharge lamp fixture.
Figure 2:
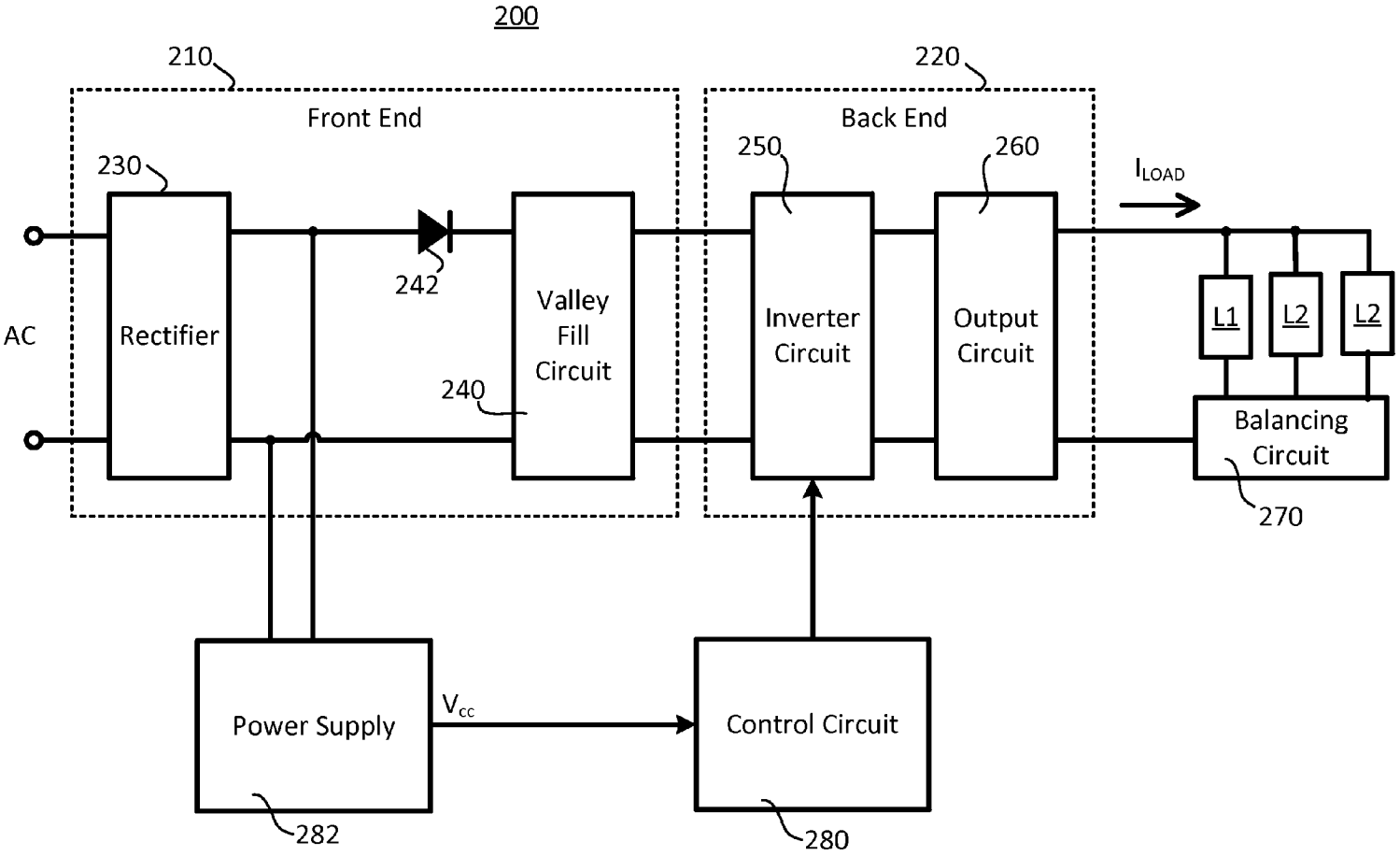
FIG. 2 Prior Art
FIG. 2 is a simplified block diagram of a prior art dimming ballast for driving multiple lamps.

An example of an electronic dimming ballast 200 for driving three fluorescent lamps L1, L2, L3 in parallel is shown in FIG. 2. The electronic dimming ballast 200 may drive any number of lamps. Electronic ballasts typically can be analyzed as comprising a front end 210 and a back end 220. The front end 210 typically includes a rectifier 230 for generating a rectified voltage from an alternating-current (AC) line voltage, and a filter circuit, for example, a valley-fill circuit 240, for filtering the rectified voltage to produce a direct-current (DC) bus voltage. The valley-fill circuit 240 may be coupled to the rectifier 230 through a diode 242 and may include one or more energy storage devices that selectively charge and discharge so as to fill the valleys between successive rectified voltage peaks to produce a substantially DC bus voltage. The DC bus voltage may be the greater of either the rectified voltage or the voltage across the energy storage devices in the valley-fill circuit 240.

The back end 220 typically includes an inverter 250 for converting the DC bus voltage to a high-frequency AC voltage and an output circuit 260 comprising a resonant tank circuit for coupling the high-frequency AC voltage to the lamp electrodes. A balancing circuit 270 may be provided in series with the three lamps L1, L2, L3 to balance the currents through the lamps and to prevent any lamp from shining brighter or dimmer than the other lamps. A control circuit 280 may generate drive signals to control the operation of the inverter 250 so as to provide a desired load current $I_{LOAD}$ to the lamps L1, L2, L3. A power supply 282 may be connected across the outputs of the rectifier 230 to provide a DC supply voltage, $V_{CC}$, for powering the control circuit 280.

Figure 3:
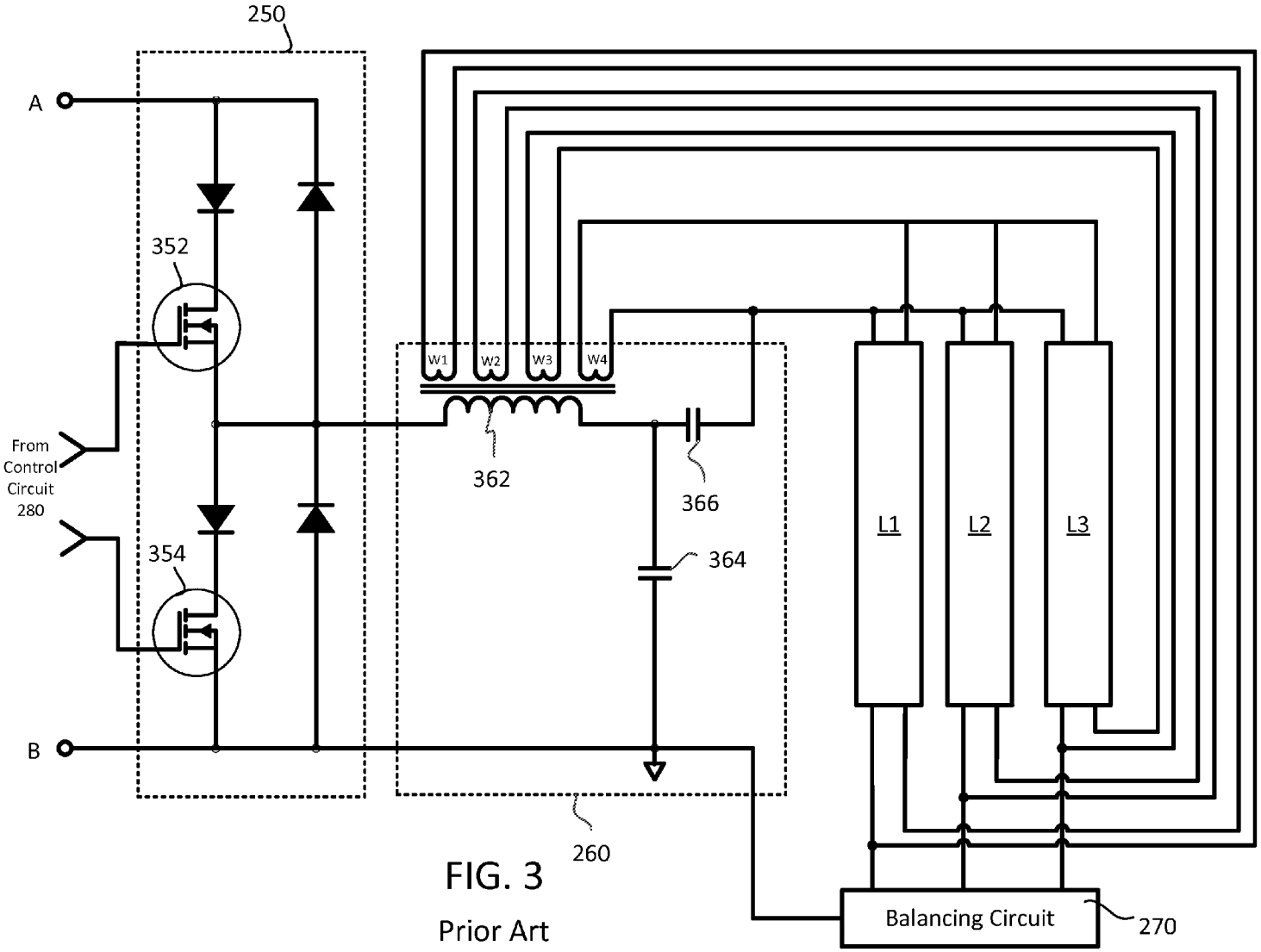
FIG. 3 Prior Art
FIG. 3 is a simplified schematic diagram of the back end of the prior art dimming ballast of FIG. 2.

FIG. 3 shows a simplified schematic diagram of the back end 220 of the electronic dimming ballast 200 for driving the lamps L1, L2, L3. As previously mentioned, the back end 220 may include an inverter 250 and an output circuit 260. The inverter input terminals A, B are connected to the output of the valley-fill circuit 240. The inverter 250 may generate a high-frequency AC voltage for driving the lamps L1, L2, L3 and may include series-connected first and second switching devices 352, 354, for example, two field-effect transistors (FETs). The control circuit 280, shown in FIG. 2, may drive the FETs 352, 354 of the inverter 250 using a complementary duty cycle switching mode of operation, e.g., a D(1-D) switching technique. This means that one, and only one, of the FETs 352, 354 is conducting at a given time. When the FET 352 is conducting, then the output of the inverter 250 is pulled upwardly toward the DC bus voltage. When the FET 354 is conducting, then the output of the inverter 250 is pulled downwardly toward circuit common.

The output of the inverter 250 is connected to the output circuit 260 comprising a resonant inductor 362 and a resonant capacitor 364. The output circuit 260 filters the output of the inverter 250 to supply a substantially sinusoidal voltage to the parallel-connected lamps L1, L2, L3. A DC blocking capacitor 366 prevents DC current from flowing through the lamps L1, L2, L3. Filament windings W1, W2, W3, W4 are magnetically coupled to the resonant inductor 362 of the output circuit 260 and are coupled to the filaments of the lamps L1, L2, L3.

The windings W1, W2, W3 may be referred to as independent filament windings because each is coupled to a respective filament of each of several different lamps (e.g., winding W1 is coupled to a filament of lamp L1; winding W2 is coupled to a filament of lamp L2; and winding W3 is coupled to a filament of lamp L3). The winding W4 may be referred to as a common filament winding because it is coupled to the filaments of all three lamps L1, L2, L3. The common filament winding may be electrically connected to the filaments such that the filaments are in series with one another or in parallel with one another. FIG. 3 illustrates the common filament winding as being electrically connected to the filaments such that the filaments are in parallel to one another.

The filament windings provide AC filament voltages within a range appropriate for the specific lamp type being driven. A lamp type, such as the T8 lamp type for example, may be provided with an AC filament voltage of approximately 3 to 5 $V_{RMS}$. Another lamp type, such as the T5HE lamp type for example, may be provided with an AC filament voltage of approximately 5 to 8 $V_{RMS}$. The filaments especially need to be heated when the ballast is dimming the lamps to low end and during preheating of the filaments before striking the lamp.

Figure 4A:
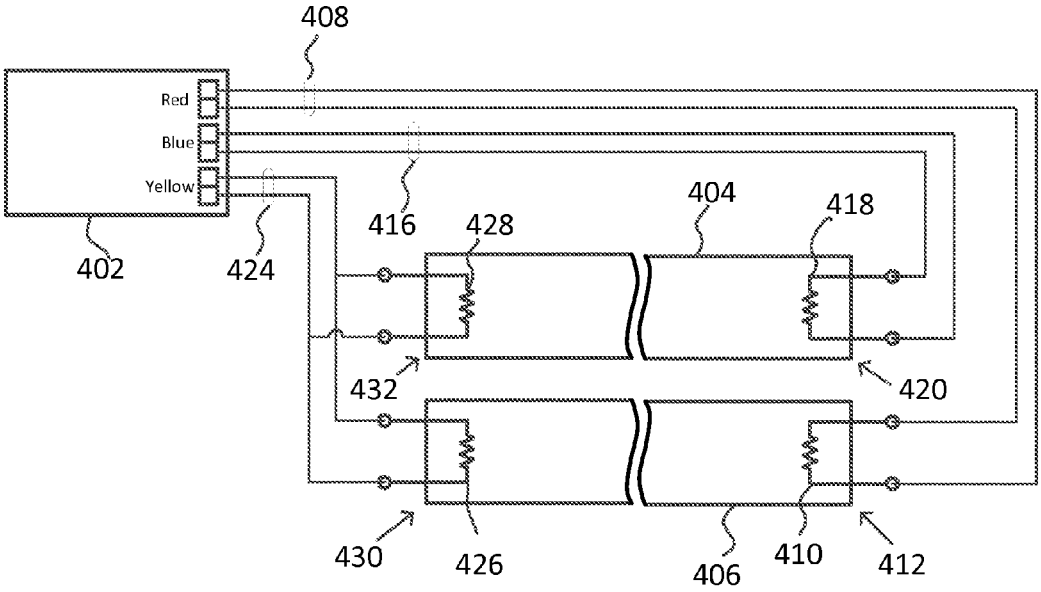
FIGS. 4A and 4B are diagrams of a ballast and corresponding gas discharge lamps having filaments wired in parallel and in series, respectively.
Figure 4B:
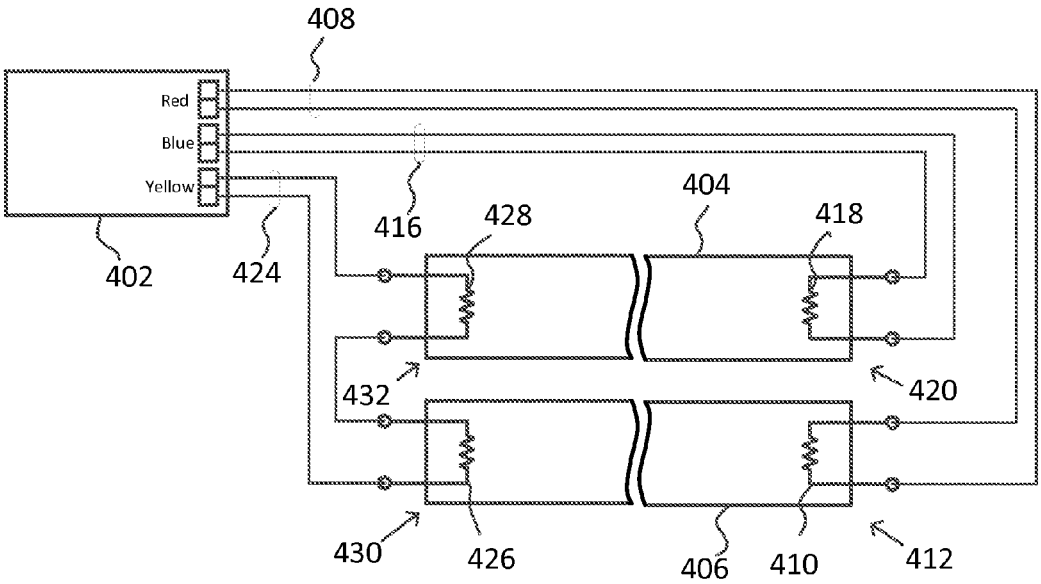

As mentioned above, the example ballast of FIG. 2 and FIG. 3 illustrates the common filament winding W4 wired such that the filaments are in parallel to one another. Another example ballast may have the common filament winding wired to the filaments, such that the filaments are in series with one another. FIGS. 4A and 4B are example wiring diagrams showing how a ballast 402 may be wired to lamps 404, 406 (i.e., wired to the sockets holding the lamps 404, 406). Two lamps 404, 406 are shown here and below for ease of illustration. The principles described may be applied to any number of lamps. In both FIGS. 4A and 4B, the ballast 402 has six output wires. Two sets of wires are from independent filament windings, such as two red wires 408 and two blue wires 416, in this example. One set of wires is from the common filament winding, such as two yellow wires 424, in this example. The red wires 408 electrically connect to the terminal ends of a filament 410 at a first end 412 of the first lamp 406. Similarly, the blue wires 416 electrically connect to the terminal ends of a filament 418 at a first end 420 of a second lamp 404. The yellow wires 424 are electrically connected to the filaments 426, 428, at the second ends 430, 432 of the first and second lamps 404, 406. FIG. 4A shows the yellow wires connected to the filaments 426, 428 in parallel. FIG. 4B shows the yellow wires connected to the filaments 426, 428 in series.

Certain ballasts are manufactured with the expectation that the common filament winding (i.e., connected to the yellow wires) is to be wired in the parallel configuration. When such a ballast has the yellow wires wired in series, the resultant fixture is miswired. Similarly, other ballasts are manufactured with the expectation that the common filament winding (i.e., connected to the yellow wires) is to be wired in the series configuration. When such a ballast has the yellow wires wired in parallel, the resultant fixture is miswired.

Figure 5B:
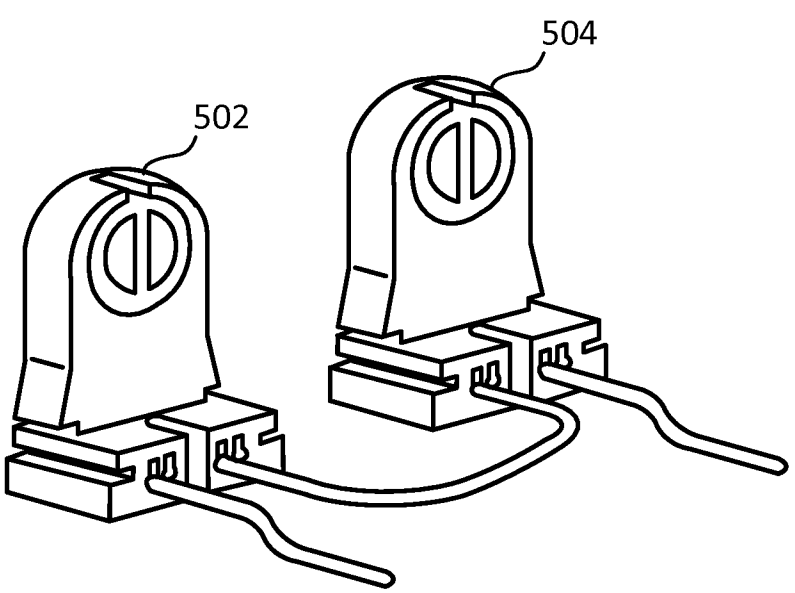
FIGS. 5A and 5B are isometric views of example gas discharge lamp sockets wired in parallel and in series, respectively.
Figure 5A:
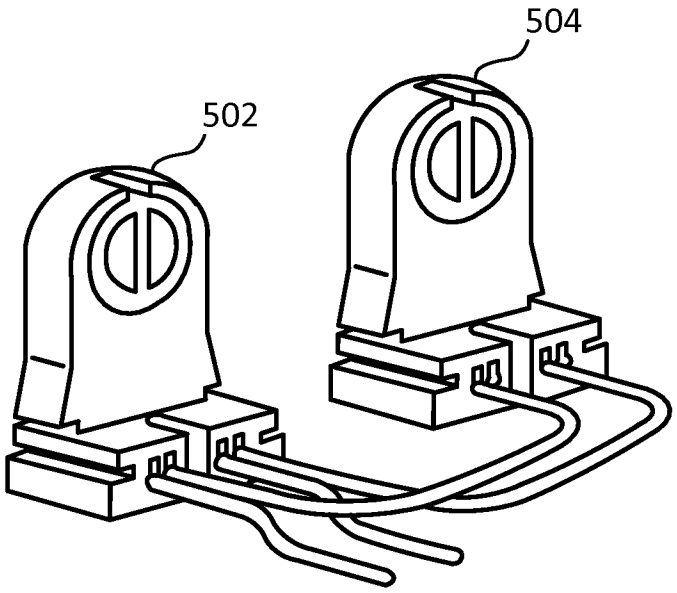

Because both wiring configurations are used in the industry, it is not uncommon for technicians, such as fixture manufacturers and/or installers, to wire the yellow wires of a ballast in series when they should be wired in parallel or to wire the yellow wires of the ballast in parallel when they should be wired in series. To illustrate the wiring from the technician's point-of-view, FIG. 5A illustrates two rapid start lamp sockets 502, 504 wired in parallel, and FIG. 5B illustrates the two rapid start lamp sockets 502, 504 wired in series.

Proper wiring of the yellow wires for a ballast is relevant to the proper operation of the ballast. Typically, the ballast is designed to impart a particular filament voltage to the filaments. This filament voltage generates a corresponding current that properly heats the filaments. When the yellow wires are miswired (e.g., wired in series when they are expected to be in parallel or wired in parallel when they are expected to be in series), the actual voltage across each of the filaments, and thus the corresponding current, may not be what was intended when the ballast was designed.

Figure 6A:
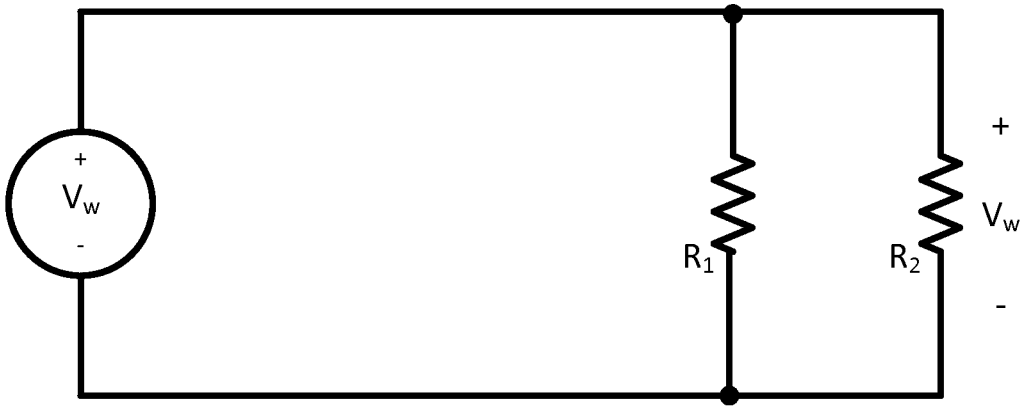
FIGS. 6A and 6B are schematic diagrams illustrating filaments wired in parallel and in series, respectively.
Figure 6B:
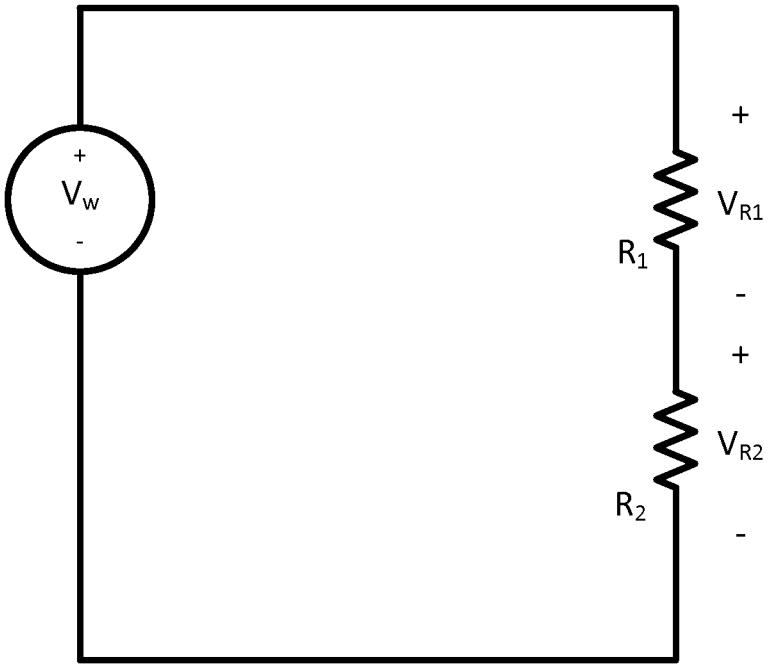

To illustrate, FIGS. 6A and 6B show two filaments, $R_1$, $R_2$, (shown as resistors) wired in parallel and in series. Because the lamp types in a given fixture would typically be the same, we can assume that the resistance values $R_1$ and $R_2$ are equal. When the filaments are wired in parallel and a common winding voltage $V_w$ generated by the common winding W4 is coupled across the filaments as shown in FIG. 6A, the voltage across each filament is the common winding voltage $V_w$. However, when the filaments are wired in series, as shown in FIG. 6B, the filaments divide the common winding voltage $V_w$ in half, as shown by the following equation:

$$V_{R1} = \frac{V_w \cdot R_1}{R_1 + R_2} = \frac{V_w}{2}$$

Figure 7:
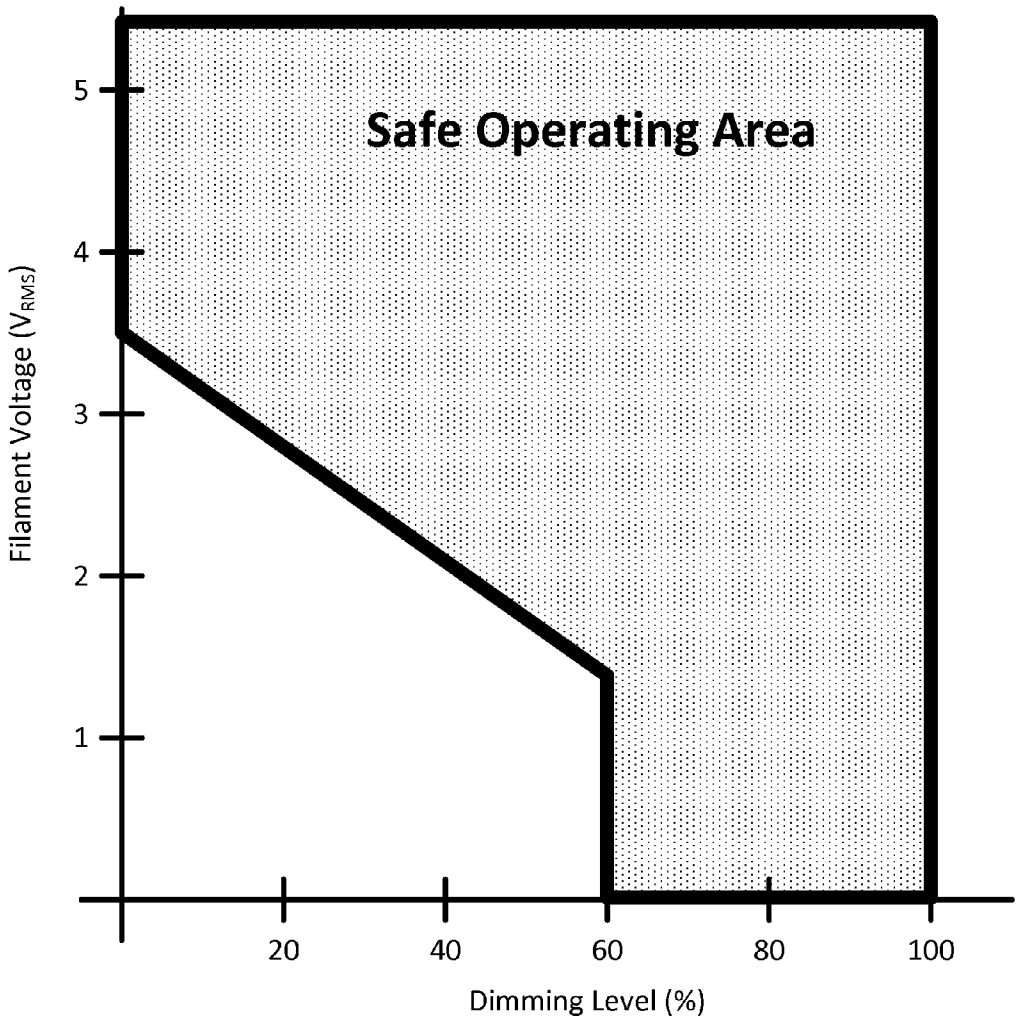
FIG. 7 is a plot of the magnitude of filament voltage versus the dimming level of the ballast illustrating a lamp safe operating area (SOA).

For sophisticated ballasts, this difference in voltage across each filament is particularly problematic when the ballast attempts to provide a relatively fine control of the heating current through the filaments. Typically, the manufacturers of gas discharge lamps establish a safe operating area (SOA) for a particular lamp-type. The SOA defines an acceptable filament voltage and/or current at various dimming levels to maximize the life of the lamp. FIG. 7 illustrates an example safe operating area (SOA). One can appreciate that a ballast designed to impart a filament voltage within a particular SOA may fail to provide the appropriate filament voltage when the yellow wires are miswired. In the example of a two-lamp ballast, the difference in filament voltage was a factor of two. Such a ballast, when miswired, would likely be outside the SOA, particularly at low dimming levels. Accordingly, it would be desirable for a ballast to accommodate miswirings, keeping the magnitudes of the filament voltages within a given SOA regardless of whether the filaments are wired in parallel or series. Moreover, it would be desirable for a ballast to achieve this result with a minimum of additional parts and cost and with little to no detriment to ballast performance.

The inclusion of a miswire protection element, for example the miswire protection element described below, may accommodate miswirings, by keeping the magnitudes of the filament voltages within a given SOA regardless of whether the filaments are wired in parallel or in series. Moreover, the inclusion of a miswire protection element may provide this miswire accommodation with a minimum of additional parts and with little to no detriment to ballast performance.

Figure 8A:
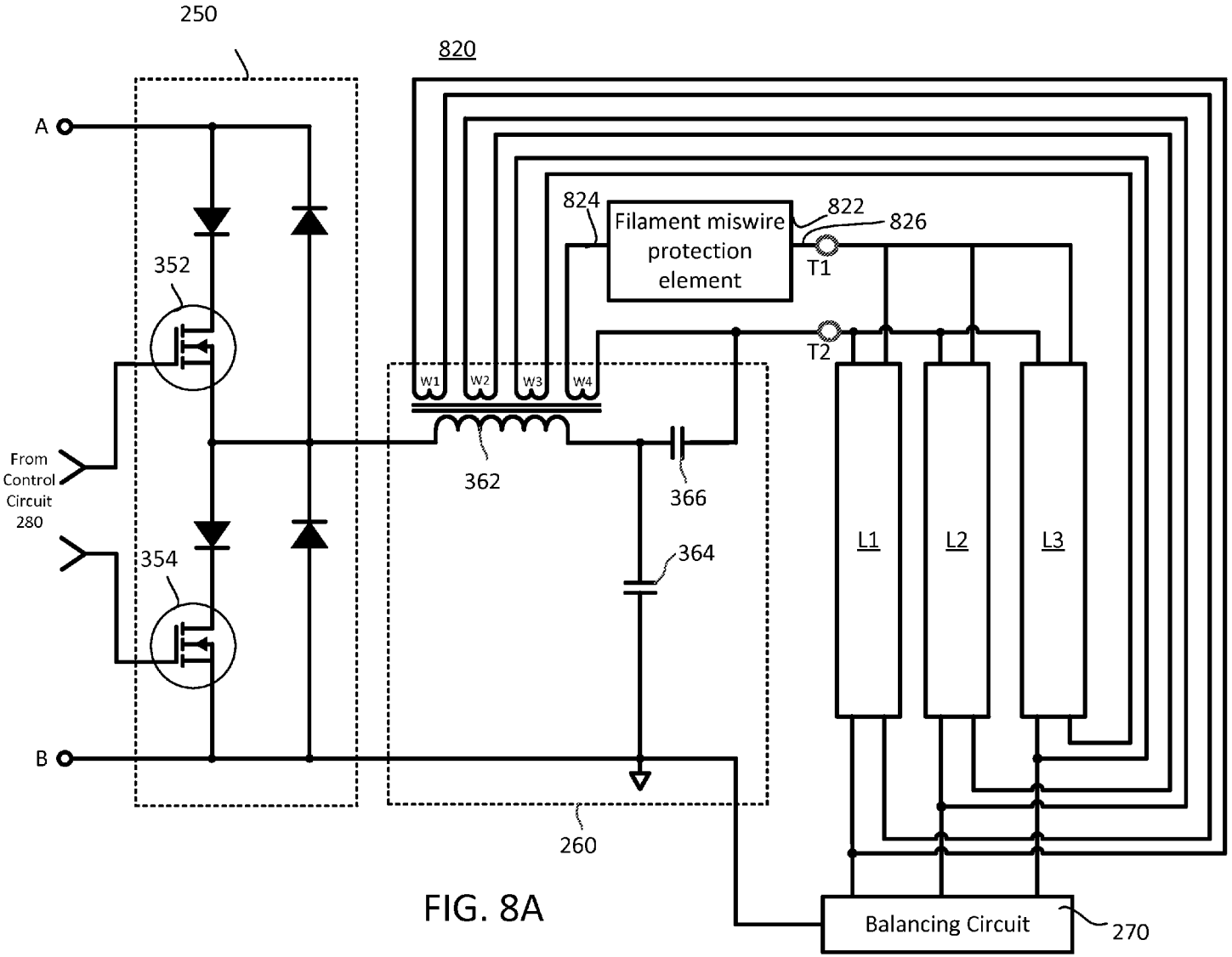
FIGS. 8A and 8B are simplified schematic diagrams of example ballast back ends each having a filament miswire protection element.

FIG. 8A is a simplified schematic diagram of an example ballast back end 820 having a filament miswire protection element 822. Similar to the back end 220 described in FIGS. 2 and 3, the back end 820 includes the inverter 250 and an output circuit 260. The inverter input terminals A, B are connected to the output of the valley-fill circuit 240. The inverter 250 generates a high-frequency AC voltage for driving the lamps L1, L2, L3 and includes series-connected first and second switching devices 352, 354, for example, two field-effect transistors (FETs). The control circuit 280 drives the FETs 352, 354 of the inverter using a complementary duty cycle switching mode of operation. This means that one, and only one, of the FETs 352, 354 is conducting at a given time. When the FET 352 is conducting, then the output of the inverter 250 is pulled upwardly toward the DC bus voltage. When the FET 354 is conducting, then the output of the inverter 250 is pulled downwardly toward circuit common.

The output of the inverter 250 is connected to the output circuit 260 comprising a resonant inductor 362 and a resonant capacitor 364. The output circuit 260 filters the output of the inverter 250 to supply a substantially sinusoidal voltage to the parallel-connected lamps L1, L2, L3. A DC blocking capacitor 366 prevents DC current from flowing through the lamps L1, L2, L3.

Filament windings W1, W2, W3, W4 are magnetically coupled to the resonant inductor 362 of the output circuit 260. The filament windings provide AC filament voltages to the filaments to keep the filaments warm through the entire dimming range. The filaments especially need to be heated when the ballast is dimming the lamps to low end and during preheating of the filaments before striking the lamp.

The windings W1, W2, and W3 are independent filament windings. The independent filament windings W1, W2, W3 are coupled to respective filaments of lamps L1, L2, L3. The winding W4 is a common filament winding. The common filament winding W4 is connected to each of the filaments of lamps L1, L2, L3 via a filament miswire protection element 822. The filament miswire protection element may be a two-node element. A first node 824 of the filament miswire protection element 822 may be connected a branch (either branch, for example) of the common filament winding W4. A second node 826 of the filament miswire protection element 822 may be connected to a filament or filaments of the lamps. As illustrated, the filaments connected to the common filament winding W4 are wired in parallel. However, as will be discussed further below, the filaments connected to the common filament winding W4 could be wired in series with the filament miswire protection element 822 accommodating for the difference in the wiring.

The filament miswire protection element 822 may be an electrical component, system, or sub-system that accommodates for miswiring of the common filament winding W4. For example, the filament miswire protection element 822 may be an electrical component, system, or sub-system that has an impedance that is approximately equal to an impedance of at least one of the filaments of lamps L1, L2, L3. Because the ballast with back end 820 may operate within a given range of frequencies, the filament miswire protection element 822 may have an impedance that, within the relevant operating frequency/frequencies, is approximately equal to an impedance of at least one of the filaments of lamps L1, L2, L3.

The filament miswire protection element 822 may be coupled to the filament winding, such as for example the common filament winding W4. The filament miswire protection element 822 may be connectable to the filaments. For example, the electronic dimming ballast may have a pair of terminals T1, T2. The filament miswire protection element 822 may be connected to one of the pair of terminals T1, T2. The pair of terminals T1, T2, may be connectable to the filaments of lamps L1, L2, L3. For example, the pair of terminals T1, T2, may be a pair of wires. For example, the pair of terminals T1, T2 may be in a terminal block. As a result, the electronic dimming ballast with back end 820 may establish, via the filament miswire protection element 822, the same voltage across a first of the filaments regardless of whether the filaments are wired in series or in parallel. The electronic dimming ballast with back end 820 may establish, via the filament miswire protection element 822, for example, a first voltage across each of the filaments when the filaments are wired in series and a second voltage across each of the filaments when the filaments are wired in parallel. Here, the first and second voltages may be approximately equal. In other words, the electronic dimming ballast with back end 820 may establish, via the filament miswire protection element 822, a voltage across each of the filaments when the filaments are wired in series that is approximately equal to a voltage that the electronic dimming ballast establishes across each of the filaments when the filaments are wired in parallel.

Figure 8B:
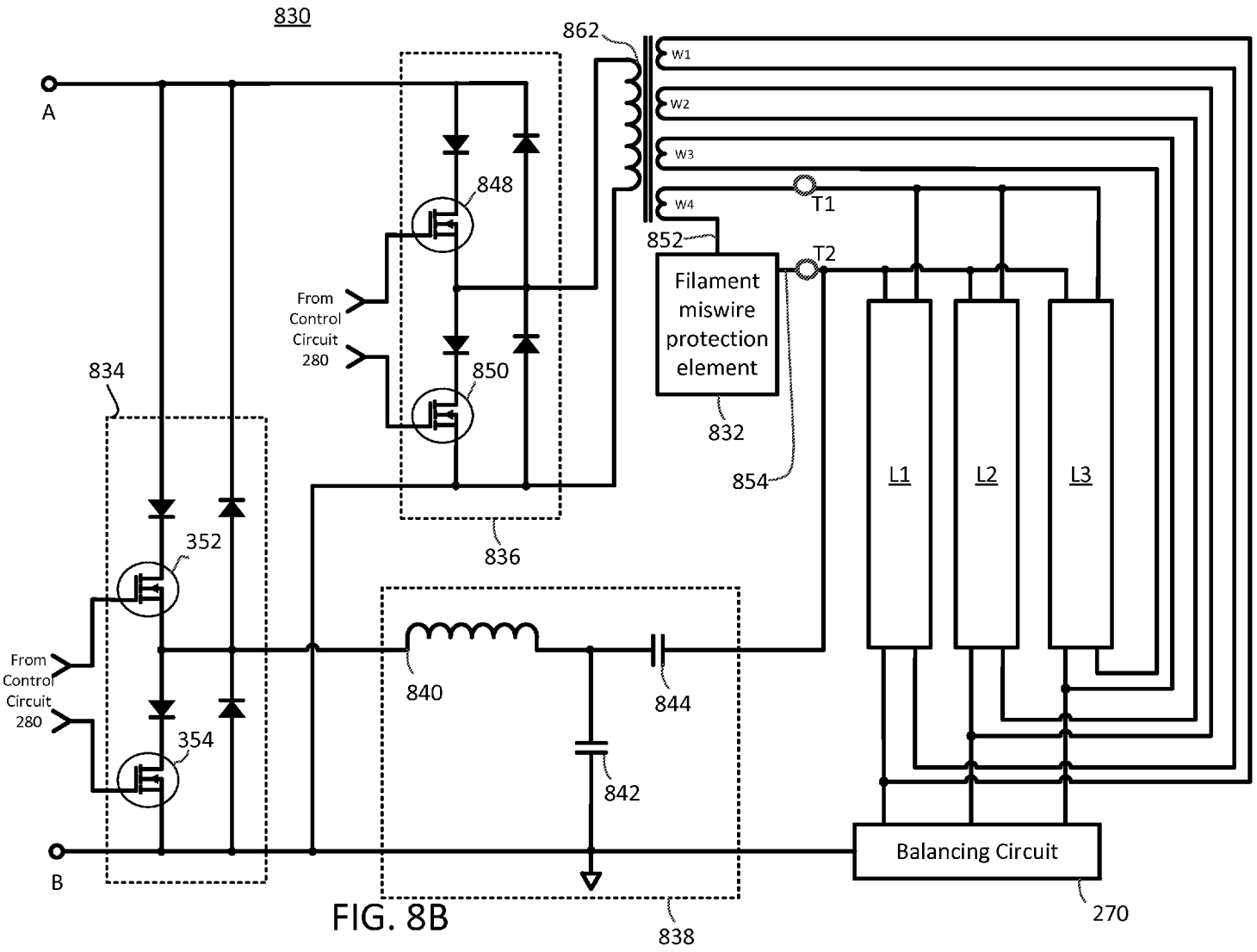

FIG. 8B is a simplified schematic diagram of example ballast back end 830 having a filament miswire protection element 832. The ballast back end 830 includes a first inverter 834 and a second inverter 836. The second inverter 836 may be different from the first inverter 834. Similar to the back end 220 described in FIGS. 2 and 3, the back end 830 includes an inverter (e.g., the first inverter 834 operates similar to the inverter 250) and an output circuit 838. The first inverter 834 may drive the lamps L1, L2, L3 via the resonant inductor 840, resonant capacitor 842, and DC blocking capacitor 844. The second inverter 836 may operate to provide an AC filament voltage via a second inductor 846.

The second inverter 836 may enable independent control of the AC filament voltage. For example, the second inverter 836 may be controlled by the control circuit 280, i.e., the same control circuit 280 that controls the first inverter 834. Alternatively, the second inverter 836 may be controlled by a control circuit (not shown) that is different from the control circuit 280 that controls the first inverter 834. The frequency of the second inverter 836 may be driven independently of the frequency of the first inverter 834. The frequency of the second inverter 836 may be driven somewhat independently of the frequency of the first inverter 834, such as operating at one-half of the frequency of the first inverter 834, for example.

The second inverter 836 may include series-connected first and second switching devices 848, 850, for example, two field-effect transistors (FETs). The FETs 848, 850 of the second inverter 836 may be driven using a complementary duty cycle switching mode of operation. This means that one, and only one, of the FETs 848, 850 is conducting at a given time. When the FET 848 is conducting, then the output of the second inverter 836 is pulled upwardly toward the DC bus voltage. When the FET 850 is conducting, then the output of the second inverter 836 is pulled downwardly toward circuit common.

Filament windings W1, W2, W3, W4 are magnetically coupled to the second inductor 846. The filament windings provide AC filament voltages to the filaments to keep the filaments warm through the entire dimming range. The filaments especially need to be heated when the ballast is dimming the lamps to low end and during preheating of the filaments before striking the lamp.

The windings W1, W2, and W3 are independent filament windings and are coupled to respective filaments of lamps L1, L2, L3. The winding W4 is a common filament winding and is connected to each of the filaments of lamps L1, L2, L3 via a filament miswire protection element 832. The filament miswire protection element 832 may be a two-node element. A first node 852 of the filament miswire protection element 832 may be connected to a branch (either branch, for example) of the common filament winding W4. A second node 854 of the filament miswire protection element 832 may be connected to a filament or filaments of the lamps. As illustrated, the filaments connected to the common filament winding are wired in parallel. However, as will be discussed further below, the filaments connected to the common filament winding could be wired in series with the filament miswire protection element accommodating for the difference in the wiring.

The filament miswire protection element 832 may be an electrical component, system, or sub-system that accommodates for miswiring of the common filament winding W4. For example, the filament miswire protection element 832 may be an electrical component, system, or sub-system that has an impedance that is approximately equal to an impedance of at least one of the filaments of lamps L1, L2, L3. Because the ballast with back end 830 may operate within a given range of frequencies, the filament miswire protection element 832 may have an impedance that, within the relevant operating frequency/frequencies, is approximately equal to an impedance of at least one of the filaments of lamps L1, L2, L3.

The filament miswire protection element 832 may be coupled to the filament winding, such as for example the common filament winding W4. The filament miswire protection element 832 may be connectable to the filaments. For example, the electronic dimming ballast may have a pair of terminals T1, T2. The filament miswire protection element 832 may be connected to one of the pair of terminals T1, T2. The pair of terminals T1, T2, may be connectable to the filaments of lamps L1, L2, L3. For example, the pair of terminals T1, T2, may be a pair of wires. For example, the pair of terminals T1, T2 may be in a terminal block. As a result, the electronic dimming ballast with back end 830 may establish, via the filament miswire protection element 832, the same voltage across the filaments regardless of whether the filaments are wired in series or in parallel. The electronic dimming ballast with back end 830 may establish, via the filament miswire protection element 832, for example, a first voltage across each of the filaments when the filaments are wired in series and a second voltage across each of the filaments when the filaments are wired in parallel. Here, the first and second voltages may be approximately equal. In other words, the electronic dimming ballast with back end 830 may establish, via the filament miswire protection element 832, a voltage across each of the filaments when the filaments are wired in series that is approximately equal to a voltage that the electronic dimming ballast establishes across each of the filaments when the filaments are wired in parallel.

Figure 9A:
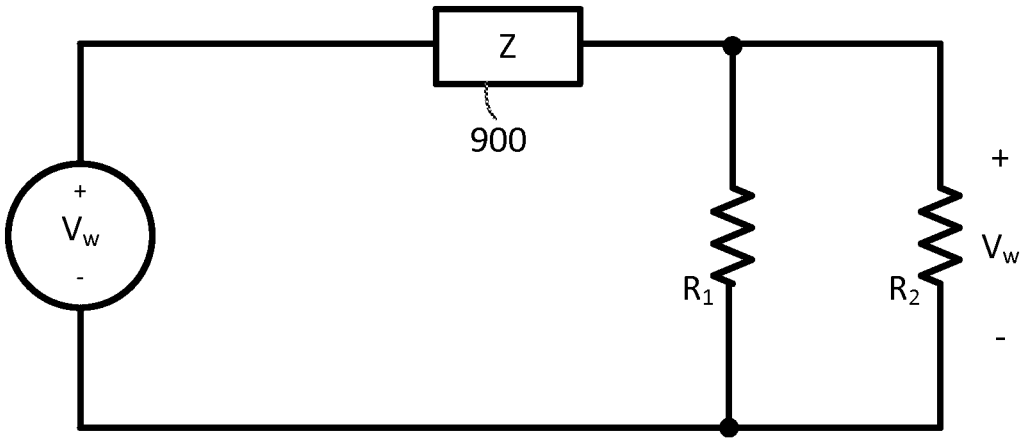
FIGS. 9A and 9B are schematic diagrams illustrating an example filament miswire protection element and filaments wired in parallel and in series, respectively.
Figure 9B:
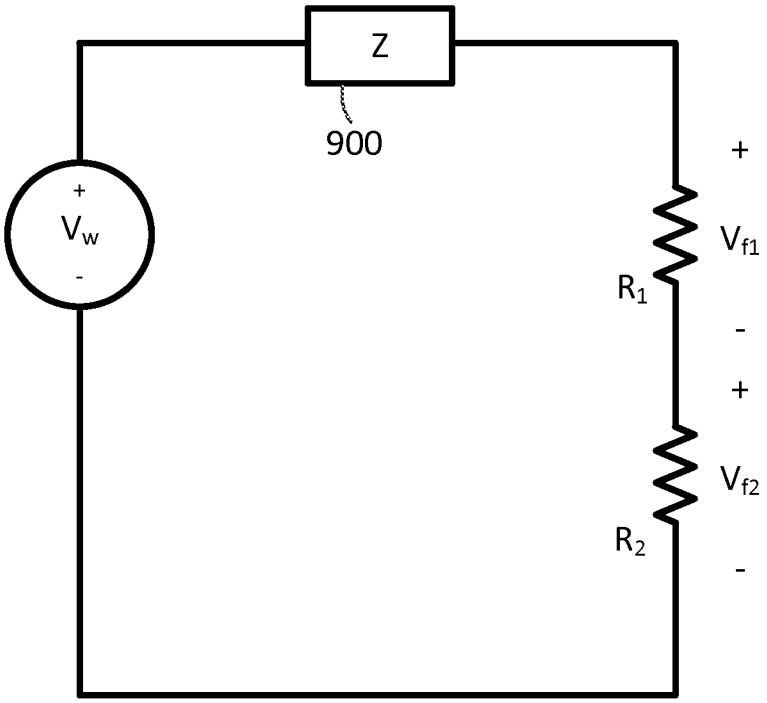

To illustrate how the miswire protection element accommodates for filament miswiring, FIGS. 9A and 9B show an example filament miswire protection element 900 with filaments $R_1$, $R_2$, (shown as resistors) wired in parallel and in series, respectively. The filament miswire protection element 900 may be wired in series with the network of the two filaments $R_1$, $R_2$. For example, in FIG. 9A, the filament miswire protection element 900 is shown in series with the two filaments $R_1$, $R_2$, being in parallel with each other. In FIG. 9B, the filament miswire protection element 900 is shown in series with two filaments $R_1$, $R_2$, with the two filaments being in series with each other. Accordingly, in FIG. 9B, the three components, the filament miswire protection element 900 and the two filaments $R_1$, $R_2$, are in series with one another.

Because lamp types in a given fixture would typically be the same, we can assume that the resistance values $R_1$ and $R_2$ are equal, having a value R. The filament miswire protection element 900 may have an impedance, Z. The impedance, Z, may be approximately equal to the resistance $R_1$, $R_2$ of one of the filaments. For example, the impedance, Z, may have the value R, the same as each of the filaments. To the extent that the impedance, Z, is a function of frequency, the absolute value of Z may have the value R at the relevant frequency of the common winding voltage $V_w$.

When the filaments are wired in parallel and the common winding voltage $V_w$ is coupled across the filaments as shown in FIG. 9A, the voltage across each filament is equal to the voltage divided between the network of parallel filaments $R_1$, $R_2$, and the filament miswire protection element 900. With the impedance Z being equal to R and with equivalent resistance of the network of parallel filaments, as shown below, the filament voltage is one-third of the common winding voltage $V_w$, as shown by the following equation:

$$V_R = \frac{V_w \cdot R_{Network\ of\ parallel\ filaments}}{Z + R_{Network\ of\ parallel\ filaments}} = \frac{V_w \cdot \frac{R_1 \cdot R_2}{R_1 + R_2}}{R + \frac{R_1 \cdot R_2}{R_1 + R_2}} = \frac{V_w \cdot \frac{R}{2}}{R + \frac{R}{2}} = \frac{V_w}{3}$$

When the filaments $R_1$, $R_2$, are wired in series, as shown in FIG. 9B, the voltage across each filament $R_1$, $R_2$, is also one-third of the common winding voltage $V_w$. Here, the voltage across each filament $R_1$, $R_2$, is equal to the voltage divided between a given filament $R_1$, for example, and the collection of remaining filaments, $R_2$ for example, and the filament miswire protection element 900. Again, with the impedance Z being equal to R, the filament voltage is one-third of the common winding voltage $V_w$, as shown by the following equation:

$$V_{R1} = \frac{V_w \cdot R_1}{(Z + R_2) + R_1} = \frac{V_w \cdot R}{3R} = \frac{V_w}{3}$$

With the proper selection of the impedance of the filament miswire protection element 900, the filament miswire protection element 900 accommodates for miswiring of the filaments. For example, the filament miswire protection element 900 may be connectable to the filaments $R_1$, $R_2$, such that the same AC filament voltage is established across a first of the filaments $R_1$, $R_2$, regardless of whether the filaments are wired in series or in parallel.

For example, the filament miswire protection element 900 may be connectable to the filaments $R_1$, $R_2$, such that a first AC filament voltage is established across each of the filaments $R_1$, $R_2$, when the filaments $R_1$, $R_2$, are wired in series, e.g., $V_{R1}$ in FIG. 9B, and a second AC filament voltage is established across each of the filaments $R_1$, $R_2$, when the filaments $R_1$, $R_2$, are wired in parallel, e.g., $V_R$ in FIG. 9A. The first and second AC filament voltages may be approximately equal, e.g., one-third of the common winding voltage $V_w$ in the above example.

For example, the filament miswire protection element 900 may be connectable to the filaments $R_1$, $R_2$, such that the AC filament voltage across each of the filaments $R_1$, $R_2$, when the filaments $R_1$, $R_2$, are wired in series is approximately equal to the AC filament voltage across each of the filaments $R_1$, $R_2$, when the filaments $R_1$, $R_2$, are wired in parallel, e.g., one-third of the common winding voltage $V_w$ in the above example regardless of whether the filaments $R_1$, $R_2$, are wired in series or in parallel to each other.

Figure 10A:
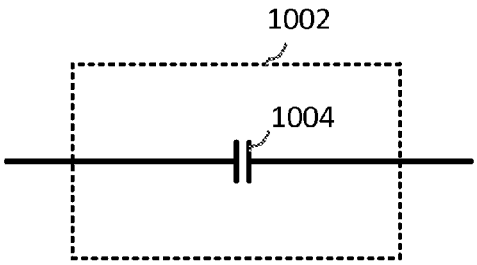
FIGS. 10A-E are schematic diagrams illustrating example filament miswire protection elements.

FIGS. 10A-E are schematic diagrams illustrating example filament miswire protection elements 1002, 1006, 1010, 1014, 1020. As shown in FIG. 10A, the filament miswire protection element 1002 may include a capacitor 1004. In an embodiment, the filament miswire protection element 1002 may be only a capacitor 1004. The impedance of the capacitor 1004 may be selected to be approximately equal to the filament impedance Z of the lamp type being served by the ballast. Because the impedance of the capacitor 1004 varies as a function of frequency, the capacitance value of the capacitor may be selected such that the absolute value of the impedance of the capacitor 1004 is approximately equal to the absolute value of the filament impedance Z at the relevant operating frequency, e.g., the frequency of the filament voltage.

Figure 10B:
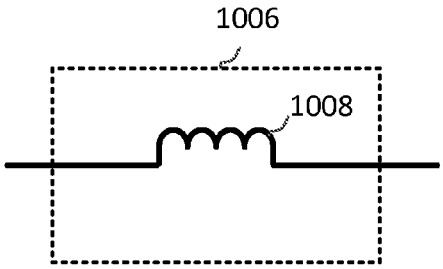

As shown in FIG. 10B, the filament miswire protection element 1006 may include an inductor 1008. In an embodiment, the filament miswire protection element 1006 may be only an inductor 1008. The impedance of the inductor 1008 may be selected to be approximately equal to the filament impedance Z of the lamp type being served by the ballast. Because the impedance of the inductor 1008 varies as a function of frequency, the inductance value of the inductor 1008 may be selected such that the absolute value of the impedance of the inductor 1008 is approximately equal to the absolute value of the filament impedance Z at the relevant operating frequency, e.g., the frequency of the filament voltage.

Figure 10C:
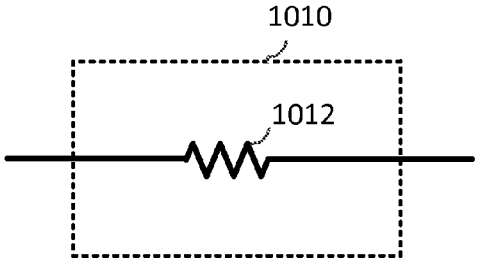

As shown in FIG. 10C, the filament miswire protection element 1010 may include a resistor 1012. In an embodiment, the filament miswire protection element 1010 may be only a resistor 1012. The resistance of the resistor 1012 may be selected to be approximately equal to the absolute value of the filament impedance Z of the lamp type being served by the ballast.

Table 1 contains example capacitance and inductance values corresponding to common lamp types at a relevant operating frequency, i.e., 50 kHz. These values are examples, and acceptable values may range within, for example, ±10% of the values shown. Acceptable values may be within a range greater than or less than the ±10% range based on the ballast design and application requirements. Such a range would result in similarly acceptable impedances being approximately equal to the corresponding filament resistances.

TABLE 1

| | Filament | Values of filament miswire protection element (at 50 kHz) | |
|---|---|---|---|
| Lamp type | resistance (ohms) | Capacitor (nF) | Inductor (uH) |
| T8 family | 12 | 265 | 38 |
| T5HE family | 40 | 79 | 127 |
| T5HO 80 W | 7 | 454 | 22 |
| T5HO 54 W | 8 | 397 | 25 |
| T5HO 39 W | 12 | 265 | 38 |
| T5HO 24 W | 12 | 265 | 38 |

Figure 10D:
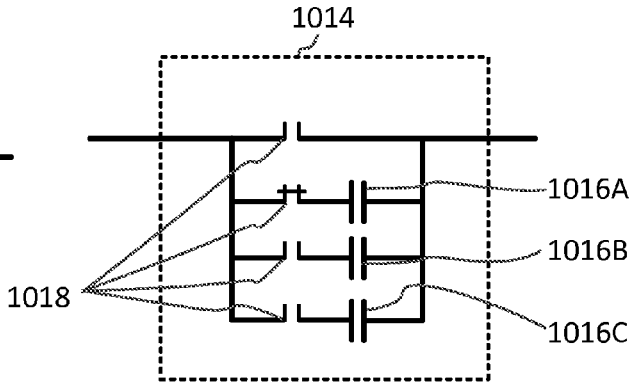

FIG. 10D illustrates a filament miswire protection element 1014 with a selectable impedance. The filament miswire protection element 1014 may include a plurality of capacitors 1016A, 1016B, 1016C that are selectable based on the shorting and/or opening of one or more jumpers 1018. The selectable impedance may be selectable by a user. For example, the selectable impedance may be selectable by a user during the manufacturing process or in the field. Though capacitors are shown in FIG. 10D, it should be understood that inductors or resistors could be used instead of or in addition to the capacitors.

Figure 10E:
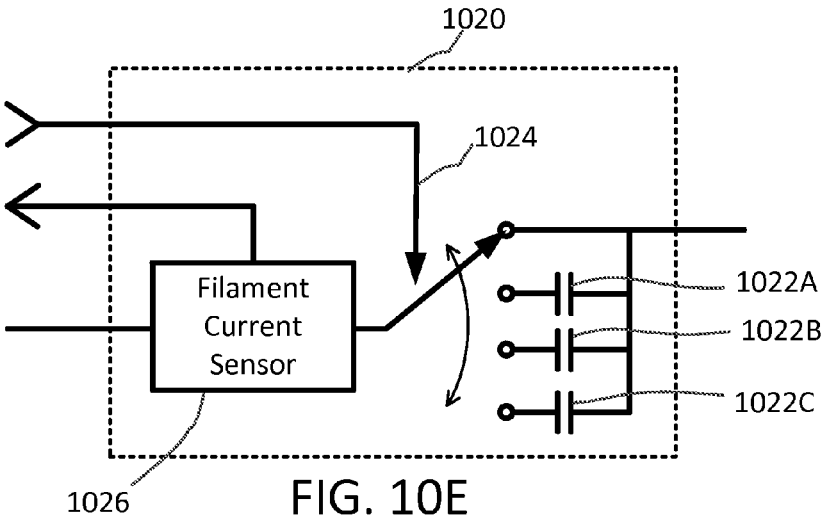

FIG. 10E illustrates a filament miswire protection element 1020 with a selectable impedance. The filament miswire protection element 1020 may include a plurality of capacitors 1022A, 1022B, 1022C that are selectable based on a controllable switch 1024. A controller (not shown) may control the controllable switch 1024 to select the appropriate capacitance value. The filament miswire protection element 1020 may include a filament current sensor 1026 that may be used by the controller to facilitate the correct selection of the appropriate capacitance value. The controller may be a microprocessor. The controller may be a control circuit of the ballast, for example control circuit 280, as illustrated in FIG. 2. Again, though capacitors are shown in FIG. 10E, it should be understood that inductors or resistors could be used instead of or in addition to the capacitors.

Figure 11:
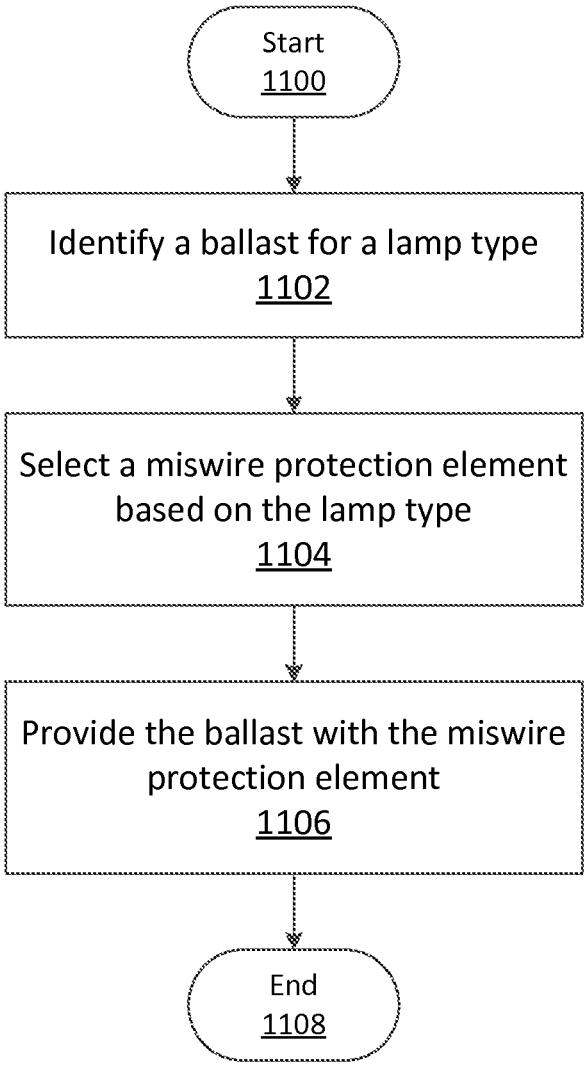
FIG. 11 is a flow chart illustrating an example method of manufacturing a ballast with a filament miswire protection element.

FIG. 11 illustrates a method of manufacturing a ballast with a miswire protection element. At 1100, the method may start. When manufacturing and/or designing a ballast, one may, at 1102, identify a ballast for a lamp type (e.g., the T8 family, T5HE family, T5HO 80W, T5HO 54W, T5HO 39W, T5HO 24W, and the like). Various lamp types may have characteristics provided by the lamp manufacturer, including for example filament resistance and/or impedance and a safe operating area.

At 1104, a miswire protection element may be selected based on the lamp type. For example, an impedance, at an operating frequency, that is approximately equal to a filament resistance of the lamp type may be selected when selecting a miswire protection element.

At 1106, a ballast with the miswire protection element may be provided. For example, instructions indicating that two terminals are to be connected to a plurality of filaments may be provided. The instructions may be written to not require that the plurality of filaments be connected in series. Similarly, the instructions may be written also to not require that the plurality of filaments be connected in parallel. Alternatively, the instructions may indicate that the plurality of filaments may be connected either in series or in parallel. At 1108, the method ends.

Although the disclosed ballast and methods have been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electronic ballast for driving a plurality of gas discharge lamps, each gas discharge lamp having a respective filament, the electronic ballast comprising:

a filament winding magnetically coupled to an inductor and operable to supply an AC filament voltage to each of the filaments;

a filament miswire protection element coupled to the filament winding and connectable to the filaments such that the same AC filament voltage is established across a first of the filaments regardless of whether the filaments are wired in series or in parallel.

2. The electronic ballast of claim 1, wherein the filament miswire protection element comprises one of a capacitor, a second inductor, and a resistor.

3. The electronic ballast of claim 1, wherein the filament miswire protection element consists of one of a capacitor, a second inductor, and a resistor.

4. The electronic ballast of claim 1, wherein the AC filament voltage has an operating frequency, and wherein the filament miswire protection element has an impedance, at the operating frequency, that is approximately equal to an impedance of at least one of the filaments.

5. The electronic ballast of claim 1, wherein the filament miswire protection element comprises a selectable inductance.

6. The electronic ballast of claim 5, wherein the selectable inductance is selectable by a user.

7. The electronic ballast of claim 5, wherein the selectable inductance is selectable by one or more jumpers.

8. The electronic ballast of claim 5, wherein the selectable inductance is selectable by a microprocessor of the ballast.

9. The electronic ballast of claim 1, further comprising:

a first inverter for generating a high-frequency AC voltage for driving the gas discharge lamp.

10. The electronic ballast of claim 9, further comprising:

an output circuit operable to receive a high-frequency AC voltage and comprising the inductor.

11. The electronic ballast of claim 9, further comprising:

a second inverter having an output coupled to the inductor for independently supplying the AC filament voltages to the filaments.

12. An electronic ballast for driving a plurality of gas discharge lamps, each gas discharge lamp having a respective filament, the electronic ballast comprising:

a filament winding magnetically coupled to an inductor and operable to supply an AC filament voltage to each of the filaments;

a filament miswire protection element coupled to the filament winding and connectable to the filaments such that a first AC filament voltage is established across each of the filaments when the filaments are wired in series and a second AC filament voltage is established across each of the filaments when the filaments are wired in parallel, wherein the first and second AC filament voltages are approximately equal.

13. The electronic ballast of claim 12, wherein the filament miswire protection element comprises one of a capacitor, a second inductor, and a resistor.

14. The electronic ballast of claim 12, wherein the filament miswire protection element consists of one of a capacitor, a second inductor, and a resistor.

15. The electronic ballast of claim 12, wherein the AC filament voltage has an operating frequency, and wherein the filament miswire protection element has an impedance, at the operating frequency, that is approximately equal to an impedance of at least one of the filaments.

16. An electronic ballast for driving a plurality of gas discharge lamps, each gas discharge lamp having a respective filament, the electronic ballast comprising:

a filament winding magnetically coupled to an inductor and operable to supply an AC filament voltage to each of the filaments;

a filament miswire protection element coupled to the filament winding and connectable to the filaments such that the AC filament voltage across each of the filaments when the filaments are wired in series is approximately equal to the AC filament voltage across each of the filaments when the filaments are wired in parallel.

17. The electronic ballast of claim 16, wherein the filament miswire protection element comprises one of a capacitor, a second inductor, and a resistor.

18. The electronic ballast of claim 16, wherein the filament miswire protection element consists of one of a capacitor, a second inductor, and a resistor.

19. The electronic ballast of claim 16, wherein the AC filament voltage has an operating frequency, and wherein the filament miswire protection element has an impedance, at the operating frequency, that is approximately equal to an impedance of at least one of the filaments.

* * * * *